US012140320B2

(12) United States Patent
Funk et al.

(10) Patent No.: US 12,140,320 B2
(45) Date of Patent: Nov. 12, 2024

(54) OVEN CAVITY WRAPPER HAVING A STRUCTURAL EMBOSSMENT AND ASSOCIATED CONVECTION FEATURES

(71) Applicant: Electrolux Home Products, Inc., Charlotte, NC (US)

(72) Inventors: Greg Funk, Nashville, TN (US); Steven M. Swayne, Springfield, TN (US); Ryan Blanchard, Charlotte, NC (US); Robert W. Smith, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 306 days.

(21) Appl. No.: 16/941,748

(22) Filed: Jul. 29, 2020

(65) Prior Publication Data

US 2022/0034516 A1 Feb. 3, 2022

(51) Int. Cl.

| | |
|---|---|
| ***F24C 7/06*** | (2006.01) |
| ***F24C 15/02*** | (2006.01) |
| ***F24C 15/08*** | (2006.01) |
| ***F24C 15/32*** | (2006.01) |

(52) U.S. Cl.

CPC ..... *F24C 7/067* (2013.01); *F24C 15/08* (2013.01); *F24C 15/325* (2013.01); *F24C 15/02* (2013.01)

(58) Field of Classification Search

CPC ..... F24C 7/067; F24C 15/08; F24C 15/02; F24C 15/007; F24C 15/325

USPC ..... 219/400

See application file for complete search history.

(56) References Cited

U.S. PATENT DOCUMENTS

| | | | | |
|---|---|---|---|---|
| 3,828,760 | A | 8/1974 | Farber et al. | |
| 5,568,803 | A | 10/1996 | Brown | |
| 7,370,647 | B2 | 5/2008 | Thorneywork | |
| 8,104,326 | B2 | 1/2012 | Tipler et al. | |
| 8,138,452 | B2 | 3/2012 | Thomas et al. | |
| 9,534,791 | B2 | 1/2017 | Wie et al. | |
| 9,939,159 | B2 | 4/2018 | Wie et al. | |
| 10,222,058 | B2 | 3/2019 | Yoon | |
| 2006/0131298 | A1* | 6/2006 | Seuk Oh | F24C 15/325 219/400 |
| 2008/0190911 | A1* | 8/2008 | Adamski | F24C 14/00 219/400 |
| 2009/0178665 | A1 | 7/2009 | Weber et al. | |

(Continued)

FOREIGN PATENT DOCUMENTS

| | | | | |
|---|---|---|---|---|
| CA | 2765850 | A1 * | 8/2012 | A47J 37/0641 |
| DE | 10219915 | | 11/2003 | |

(Continued)

*Primary Examiner* — Allen R. B. Schult
*Assistant Examiner* — William C Weinert
(74) *Attorney, Agent, or Firm* — Pearne & Gordon LLP

(57) ABSTRACT

An appliance is provided with a cavity wrapper defining a cooking chamber therein. An embossment is formed in a wall of the cavity wrapper and protrudes within the cooking chamber. The embossment has a leading sloped portion. A shroud is located adjacent the wall and includes an outer perimeter edge that is spaced from the embossment thereby defining an exhaust port therebetween. A bracket is disposed outside the cavity wrapper and includes a pair of mounting tabs affixed to an external surface of the wall of the cavity wrapper. The pair of mounting tabs straddling the embossment in a staggered formation.

19 Claims, 8 Drawing Sheets

(56) References Cited

U.S. PATENT DOCUMENTS

| | | | | |
|---|---|---|---|---|
| 2010/0059035 | A1* | 3/2010 | Nam | H05B 3/48 126/21 A |
| 2010/0147825 | A1* | 6/2010 | Bonuso | F24C 15/325 219/400 |
| 2016/0150601 | A1 | 5/2016 | Kim et al. | |
| 2017/0198919 | A1* | 7/2017 | Ye | F24C 3/002 |
| 2018/0073742 | A1 | 3/2018 | Kim et al. | |
| 2019/0003718 | A1* | 1/2019 | Lee | F24C 15/325 |
| 2020/0318834 | A1* | 10/2020 | Huang | F24C 15/00 |
| 2020/0352381 | A1* | 11/2020 | Hatchett | F24C 15/325 |
| 2021/0221513 | A1* | 7/2021 | Ten Dam | B64D 11/04 |
| 2022/0018546 | A1* | 1/2022 | Dall'Oglio | H05B 6/763 |
| 2022/0214048 | A1* | 7/2022 | Wang | F24C 15/325 |

FOREIGN PATENT DOCUMENTS

| | | | | |
|---|---|---|---|---|
| DE | 10314571 | | 10/2004 | |
| DE | 202004013917 | | 10/2004 | |
| DE | 102004003116 | | 8/2005 | |
| DE | 102004047993 | | 4/2006 | |
| DE | 102005036813 | | 2/2007 | |
| DE | 102006004384 | | 8/2007 | |
| DE | 102010029308 | | 12/2011 | |
| DE | 102010036462 | | 1/2012 | |
| DE | 102011079233 | | 1/2013 | |
| DE | 102013113160 | | 5/2015 | |
| DE | 102016102754 | | 4/2017 | |
| EP | 1464898 | A1 * | 10/2004 | F24C 15/322 |
| WO | WO-2015155637 | A1 * | 10/2015 | F24C 15/08 |

* cited by examiner

OVEN CAVITY WRAPPER HAVING A STRUCTURAL EMBOSSMENT AND ASSOCIATED CONVECTION FEATURES

FIELD OF THE INVENTION

This application relates generally to an oven appliance having a cavity wrapper that defines a cooking chamber and, more specifically, to a cavity wrapper having a structural embossment that aids in providing robust, strengthened affixation and improved orientation stability relative to structural support features or body members of the oven appliance. The structural embossment further provides a deflection surface for redirecting a convection heated airflow.

BACKGROUND OF THE INVENTION

Conventional oven appliances include a muffle (also called a cavity wrapper, which defines a cooking chamber) disposed within an outer body of the appliance and secured to structural elements thereof. The muffle is structurally supported by structural features of the outer body. Common means of attaching the muffle to the structural features of the outer body include a pedestal that holds the bottom of the muffle at the correct elevation within the outer body above a floor, and/or hooks provided on a wall of the muffle that engage respective slots formed in structural elements of the outer body. Such means add extra components to the overall appliance and/or complex steps during manufacturing. Additionally, brackets are known to attach the muffle to the outer body structural elements. However, such brackets generally include mounting features that centralize support loads at a common location, thereby decreasing the structural stability of the muffle and the ability to maintain the muffle at its correctly installed orientation.

Furthermore, conventional oven appliances employ convection to accelerate the rate at which thermal energy is transferred into a load (e.g., food) to be cooked. To be most efficient and effective, a convection airflow should flow directly across the load. However, as the convection elements (e.g., convection heating element, fan, etc.) are often disposed adjacent a rear wall of the muffle, the airflow must be deflected from the rear wall towards the load. Conventional means for deflecting the airflow include permitting the side walls of the muffle to redirect the airflow forward, as well as additional bolt-on components affixed to or depending from the walls of the muffle; such as separately attached baffles. Deflecting the airflow via the side walls of the muffle is thermally inefficient because they will absorb energy from the flowing air before that air reaches the cooking load—i.e. the side walls can act as heat sinks. Further, the use of additional deflection components such as baffles increases cost and adds complexity to the appliance.

BRIEF SUMMARY

In accordance with one aspect, there is provided an appliance including a cavity wrapper having a rear wall and defining a cooking chamber therein. An embossment is formed in the rear wall, follows a closed path, and protrudes within the cooking chamber. The embossment has a leading sloped portion.

A shroud is located adjacent to the rear wall and defines therewith a heating chamber that is partially isolated from a main volume of the cooking chamber. The shroud has a primary intake therein and an outer perimeter edge that is spaced from the embossment thereby defining an exhaust port therebetween.

A fan is disposed within the heating chamber and is configured to draw air from the main volume into the heating chamber via the primary intake. The fan expels the air from the heating chamber back into the main volume via the exhaust port such that the expelled air is redirected substantially forward into the main volume based on an angle of the leading sloped portion of the embossment.

In accordance with another aspect, there is provided an oven including a cavity wrapper defining a cooking chamber therein. The cavity wrapper includes a top wall, a bottom wall, a rear wall, and a pair of opposing side walls. An embossment is formed in the rear wall and protrudes within the cooking chamber. The embossment follows an uninterrupted closed path such that the embossment defines an inner portion and an outer portion of the rear wall. The inner portion is surrounded by the embossment, and the outer portion surrounds the embossment. The embossment includes a leading sloped portion that depends from the inner portion of the rear wall, and that is sloped with respect to a planar expanse of the rear wall.

A shroud is located adjacent the rear wall and defines therewith a heating chamber partially isolated from a main volume of the cooking chamber. The shroud covers the leading sloped portion of the embossment. The shroud has a primary intake formed therein and a perimeter edge spaced from the embossment to define an exhaust port therebetween. The perimeter edge follows the embossment in adjacency therewith along the closed path.

A fan is disposed within the heating chamber and is configured to draw air from the main volume of the cooking chamber into the heating chamber via the primary intake. The fan expels the air from the heating chamber back into the main volume of the cooking chamber via the exhaust port. The air is exhausted from the heating chamber such that the air does not directly impinge any one of the top wall, the bottom wall, and the pair of opposing side walls.

In accordance with yet another aspect, there is provided an appliance including a cavity wrapper defining a cooking chamber therein. An embossment is formed in the wall of the cavity wrapper and protrudes within the cooking chamber. A bracket is disposed outside the cavity wrapper and is adapted to provide support thereto. The bracket includes a first pair of mounting tabs affixed to an external surface of the wall of the cavity wrapper. The first pair of mounting brackets straddle the embossment in a staggered formation.

DESCRIPTION OF EXAMPLE EMBODIMENTS

Figure 1:
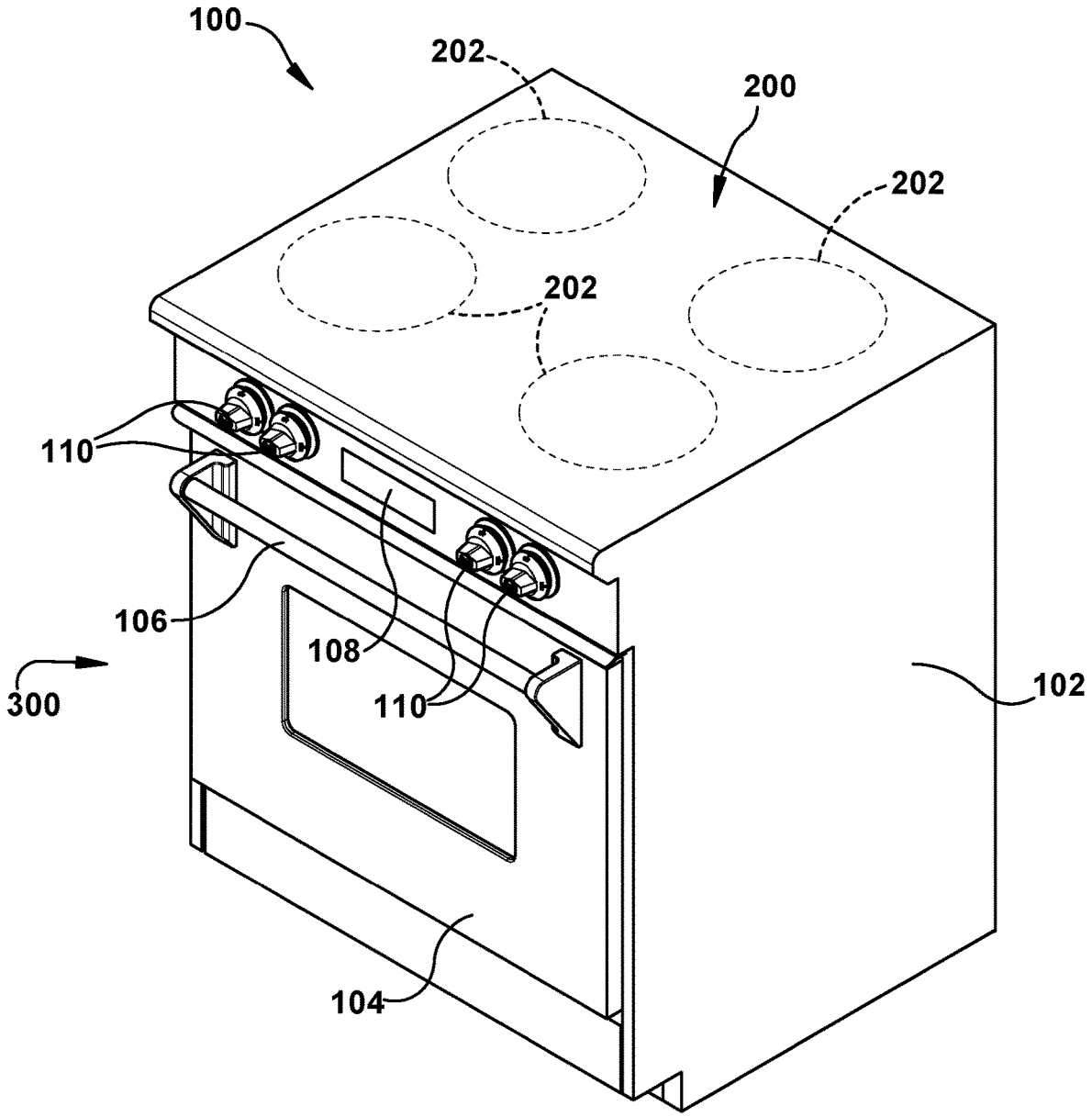
FIG. 1 is a schematic perspective view of a cooking appliance having a cooktop and an oven.

Referring now to the drawings, FIG. 1 depicts a cooking appliance 100 having an outer body 102 that defines an external appearance thereof. Specifically, the outer body 102 can include structural features (e.g., braces, struts, etc., not shown) as well as decorative features (e.g., outer panels adhered to the structural features). Alternatively, where the external panels have been engineered to be structurally robust against external loads, then those panels themselves may be or include the structural features to which other internal components of the appliance 100 are affixed. The cooking appliance 100 can be a domestic appliance configured for in-home use, or an industrial appliance for commercial applications. In the illustrated example, the cooking appliance 100 includes a cooktop 200 and an oven 300. The cooktop 200 is located at a top side of the cooking appliance 100 and includes at least one heating element 202. Specifically, the heating element 202 can be a gas burner, an electric resistive coiled wire, an induction element, or any other type of heating element.

The cooking appliance 100 further includes a door 104 pivotably coupled to the front of the appliance and configured to provide selective access to the oven 300. For example, a handle 106 is disposed on an outer surface of the door 104 and enables a user to open the door 104 to permit access to the oven 300. As schematically shown in FIG. 1, a display panel 108 and inputs 110 (e.g., rotatable dials, slidable switches, mechanical buttons, and/or electronic buttons) can be disposed on a front surface of the outer body 102 (e.g., in case of a front-control appliance). During operation, a user interacts with the inputs 110 to activate/control the cooktop 200 and/or the oven 300. The display panel 108 depicts operational information of the cooking appliance 100 and may even include selectable inputs (e.g., touch-inputs).

While the features disclosed below are made with respect to the aforementioned cooking appliance 100, they are not limited thereto, and other cooking appliances and/or combinations of cooking appliances are contemplated.

Figure 2:
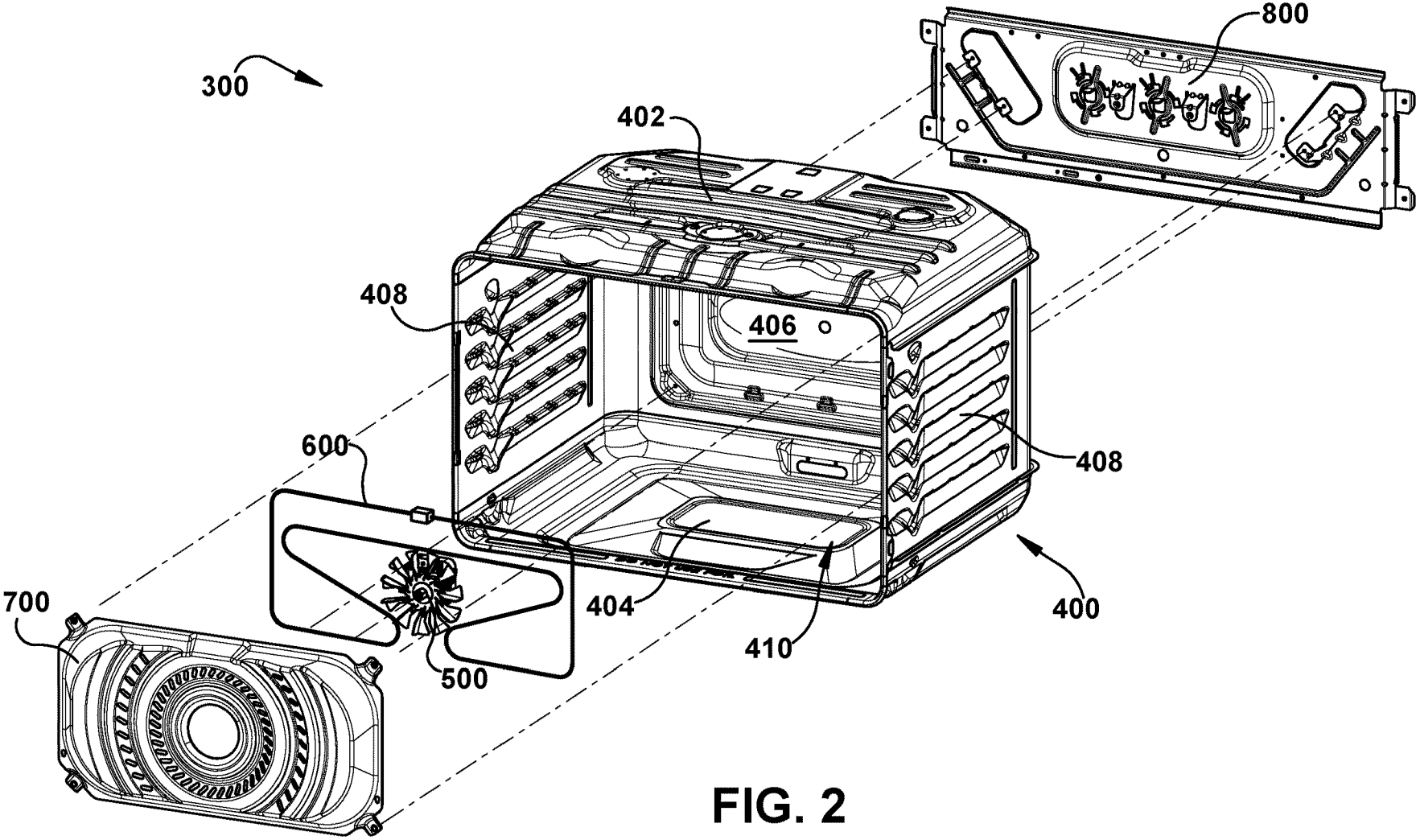
FIG. 2 is an exploded view of features of the oven of the appliance, including a mounting bracket, a cavity wrapper, a convection fan and associated convection heating element, and a convection shroud.

Moving now to FIG. 2, selected features of the oven 300 are shown in an exploded view, removed from the outer body 102. The oven 300 includes a cavity wrapper 400, a convection fan 500, a convection heating element 600, a convection shroud 700, and a mounting bracket 800. As shown, the cavity wrapper 400 includes a top wall 402, a bottom wall 404, a rear wall 406, and a pair of opposing side walls 408 that collectively define a cooking chamber 410. The cavity wrapper 400 typically is formed from stamped sheet metal, and can be made in sections and adhered together via welding, as known in the art. Optionally, the cavity wrapper 400 can be coated with a ceramic material (e.g., a porcelain or enamel coating), also known in the art.

Figure 3:
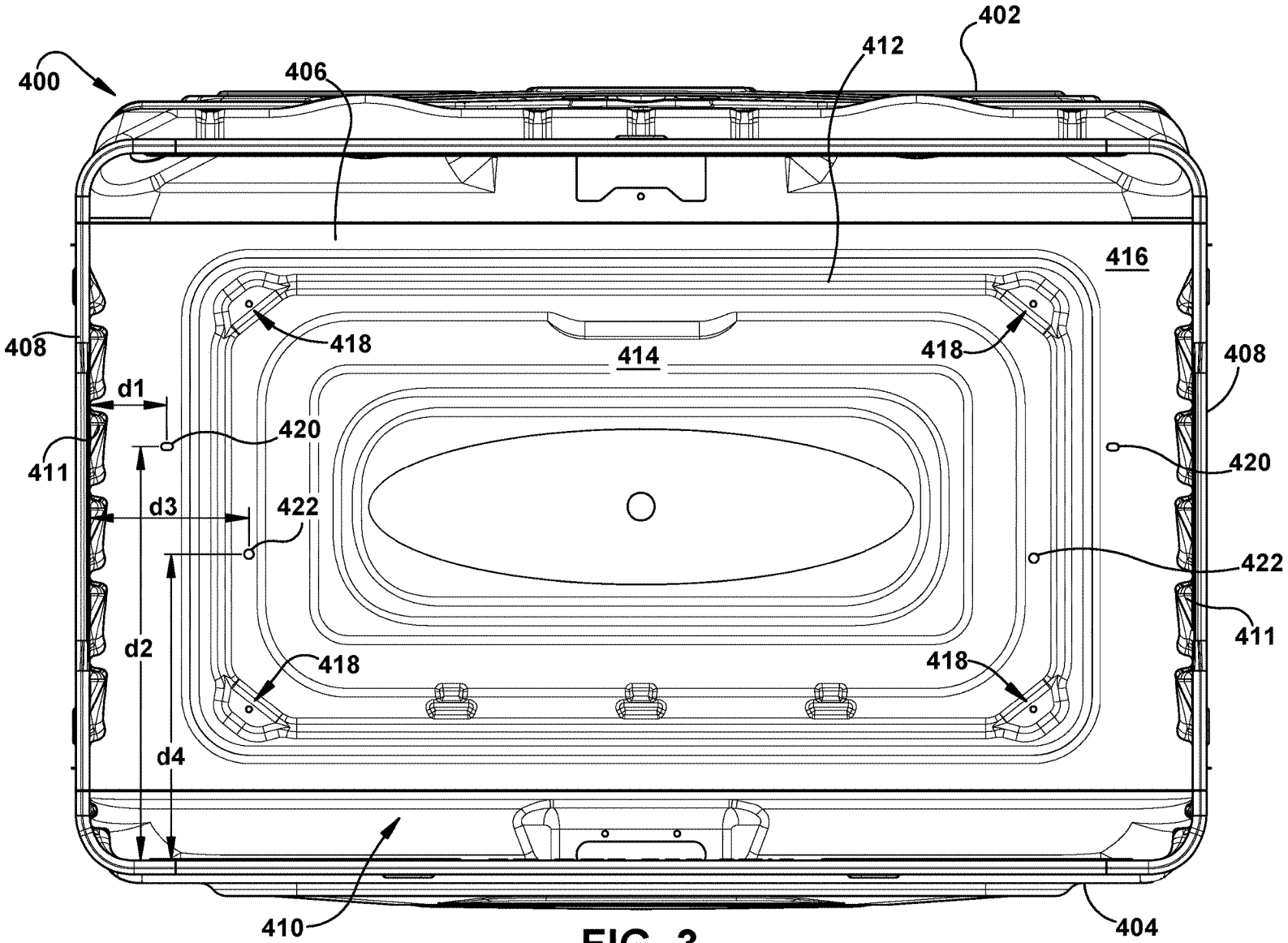
FIG. 3 is a front view of the cavity wrapper shown in FIG. 2 with other elements removed, which has a structural embossment on a rear wall thereof.

With respect to FIG. 3, a front view of the cavity wrapper 400 is shown wherein the cooking chamber 410 is visible through a front opening thereof. Each of the side walls 408 includes a series of rack embossments 411 formed therein and vertically spaced thereon for supporting cooking racks (not shown) at different levels within the cooking chamber 410. Specifically, each rack embossment 411 is arranged on a respective side wall 408 and extends along a depth of that side wall 408 between the rear wall 406 and the front opening of the cavity wrapper 400.

As further shown, the rear wall 406 of the cavity wrapper 400 includes an embossment 412 formed (e.g., pressed) therein that protrudes inward within the cooking chamber 410, away from the rear wall 406 (i.e., the embossment 412 protrudes within the interior of the cooking chamber 410). The embossment 412 can be a stamped emboss made in the rear wall 406 while or shortly after it is manufactured (e.g. in a single stamping step), such that the embossment 412 protrudes from the rear wall 406. The embossment 412 structurally strengthens the cavity wrapper 400 in the vicinity of the embossment 412 on the rear wall 406 to provide robust attachment points for affixing the cavity wrapper 400 to other structural elements of the appliance 100 exterior to the cooking chamber 410, as will be discussed further below.

As shown, the embossment 412 preferably follows a closed (i.e., uninterrupted), preferably rectangular path centered in the rear wall 406 and extending generally between the side walls 408 and the top and bottom walls 402, 404 of the cavity wrapper 400. This configuration divides the rear wall 406 into an inner portion 414 and an outer portion 416, the intersection of which is provided at or by the embossment 412. The inner portion 414 is defined as an area of the rear wall 406 peripherally surrounded or defined by the embossment 412, and the outer portion 416 is defined as an area of the rear wall 406 located peripherally outside the embossment 412 and adjacent to the respective side walls 408, and top and bottom walls 402, 404.

While it is shown that the embossment 412 has a closed (i.e., uninterrupted) configuration, it is contemplated that the embossment 412 can include or be defined by a plurality of discrete sections or sub-embossments that collectively define an enclosed shape. For example, although in the illustrated embodiment the embossment 412 is rectangular having rounded corners when viewed from the front opening, alternatively it could be defined by a plurality of embossment segments (e.g. top, bottom, left and right segments) arranged in or generally defining a rectangle, but unjoined with one another at common corners. Further, it is contemplated that the embossment 412 may follow a path on the rear wall 406 having any other geometric shape (e.g., square, oval, circle, etc.).

A plurality of receptacles 418 are formed in the embossment 412, generally at the corners thereof, and are configured to receive respective mounting feet 706 of the shroud 700, as will be detailed below. Each of the receptacles 418 is formed as a partial recess in the otherwise protruding embossment 412 within the cooking chamber 410, so that each appears to be pressed into the embossment 412 toward the rear wall 406, thus yielding a step-down feature when viewed from the front opening (within the chamber 410). That is, the embossment 412 protrudes from the rear wall 406 and partially surrounds each receptacle 418. The receptacles 418 can be generally planar with portions of the rear wall 406 either bounded by or surrounding the embossment 412, or they can be recessed behind those portions of the rear wall 406 (or they can be positioned forward thereof, within the cooking chamber 410). Further, the receptacles 418 are shown as being disposed adjacent the inner portion 414 of the rear wall 406 (i.e., substantially within the area defined by the embossment 412). However, this need not be the case as the receptacles 418 can be disposed adjacent the outer portion 416 of the rear wall 406. Each of the receptacles 418 includes a pre-drilled hole configured to receive a fastener (e.g., screw, bolt, etc.) therein to attach the shroud 700 to the rear wall 406. Alternatively, the shroud 700 can be secured to the receptacles 418 via a self-tapping screw, thus eliminating the need for the pre-drilled holes.

The cavity wrapper 400 further includes first and second pairs of apertures 420, 422 (e.g., pre-drilled holes) on the rear wall 406 thereof, each said pair straddling a respective side portion of the embossment 412 adjacent a respective side wall 408 of the cavity wrapper. That is, within each said pair, the first aperture 420 is located in the outer portion 416 of the rear wall 406 between the embossment 412 and the associated side wall 408, whereas the second aperture 422 is located in the inner portion 414 of the rear wall 406 just opposite the embossment 412, preferably at a different elevation on the rear wall 406. Again in each said pair, the first aperture 420 is located a distance dl from the associated side wall 408 and a distance d2 from the bottom wall 402, while the second aperture 422 is located a distance d3 away from the associated side wall 408 and a distance d4 away from the bottom wall 404; wherein the distance d2 preferably is different from (i.e. greater than, as shown) the distance d4. The distance d2 can be greater than or less than d4, though preferably they are not the same. This results in each pair of the first and second apertures 420, 422 being vertically offset from one another in a staggered formation at either side of the embossment 412.

Briefly moving back to FIG. 2, the convection fan 500 is a centrifugal fan that draws air along its axis and redirects the air to exit in the radial direction. Specifically, the convection fan 500 draws air from within a central area of the cooking chamber 410 and redirects said air radially in a direction towards the top wall 402, the bottom wall 404, and the opposing side walls 408. Moreover, the convection heating element 600 is shown as being a single (continuous) electrically resistive wire having a plurality of bends. However, it is contemplated that a plurality of electrically resistive wires can collectively make up the convection heating element 600, or other heat sources known in the art (e.g., gas) can be used.

Figure 4A:
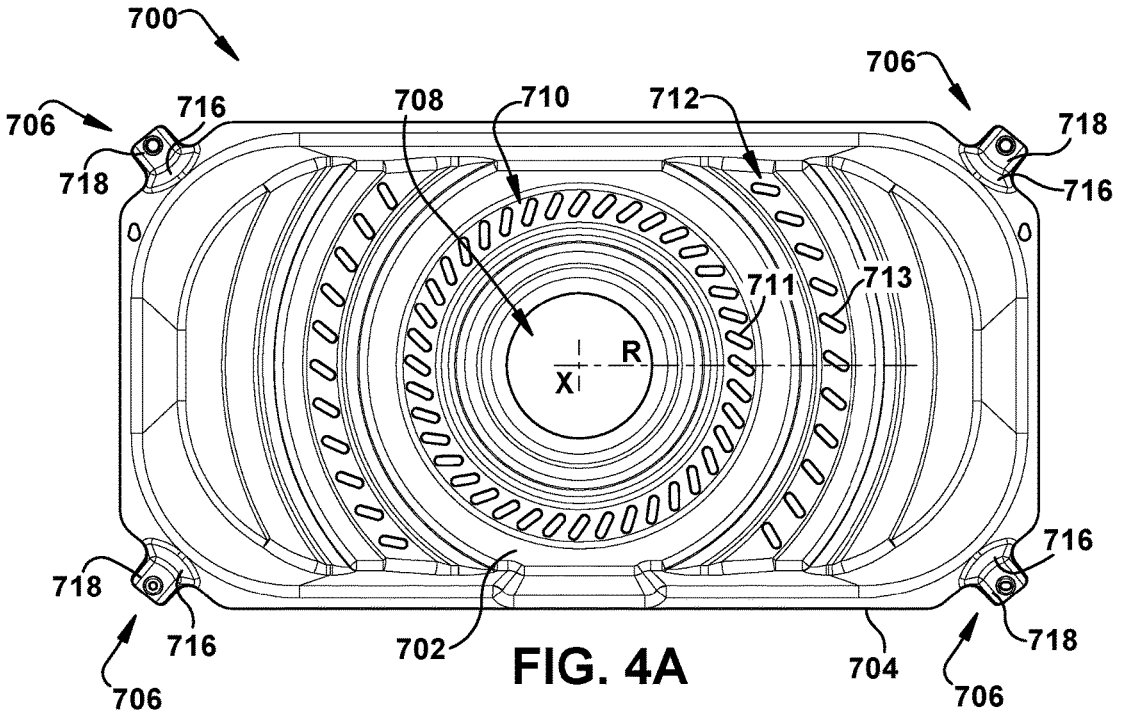
FIG. 4A is a front view of the shroud shown in FIG. 2.
Figure 4B:
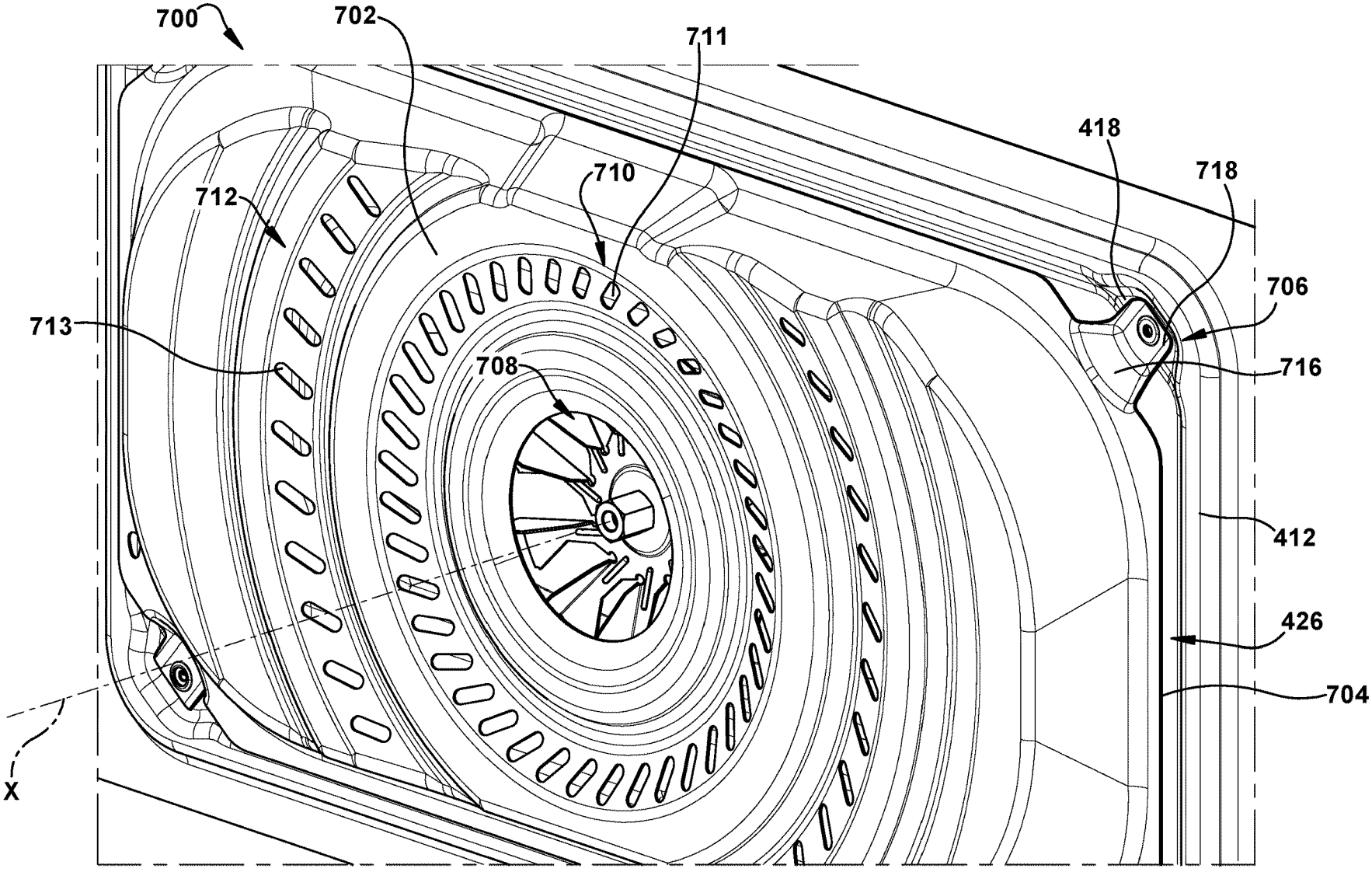
FIG. 4B is partial perspective view of the shroud shown in FIG. 4A attached to the cavity wrapper.

Moving on to FIG. 4A, the convection shroud 700 in the illustrated embodiment has a substantially rectangular body 702 having an outer, perimeter edge 704. While the body 702 is shown as being rectangular, it is contemplated that the body 702 can have any geometric shape (e.g., square, circular, oval, etc.), and as will be further described below, preferably has a shape corresponding to that of the embossment 412 in the rear wall 406 of the cavity wrapper 400. The convection shroud 700 includes a plurality of mounting feet 706 formed integral therewith (i.e., during a single manufacturing process, such as by stamping from a common piece of sheet metal to produce the convection shroud 700). Alternatively, the mounting feet 706 can be formed separately and subsequently attached to the body 702 of the convection shroud 700. The mounting feet 706 can be formed as tabs dimensioned complementarily to and adapted to be received within the respective receptacles 418 in the rear wall 406 of the cavity wrapper 400, as shown in FIG. 4B and further detailed below. The mounting feet 706 are disposed adjacent to and preferably extend from the perimeter edge 704 of the body 702. The mounting feet 706 each can include a stand-off portion 716 and a mounting portion 718 (shown in FIG. 4B), wherein the stand-off portion 716 extends rearward at an angle (e.g. substantially perpendicular) relative to a planar expanse of the body 702, and the mounting portion 718 extends substantially parallel to the planar expanse of the body 702 in order to be cooperatively received and mounted within the associated receptacle 418.

The convection shroud 700 further includes first, second, and third intakes 708, 710, 712, all configured to permit a flow of air to pass therethrough. Specifically, the first intake 708 is a primary intake comprising a centrally located through-hole formed in the body 702. As shown, the first intake 708 has a circular shape; however, it is to be understood that other geometric shapes are contemplated (e.g., square, rectangular, etc.).

The second and third intakes 710, 712 are secondary intakes (i.e., through-holes formed in the body 702) configured to supplement radial airflow through the convection shroud 700 from within the cooking chamber 410 toward the convection fan 500 located behind the convection shroud 700, in-use. As shown, the second intake 710 comprises a plurality of circumferentially spaced, slot-shaped through-holes 711 disposed radially outwards from and preferably concentric with the first intake 708. Preferably, each of the slot-shaped through-holes 711 that together define the second intake 710 is angled with respect to an imaginary line R extending radially from a central axis X of the first intake 708 to said through-hole 711. This configuration applies to each of the slot-shaped through-holes 711 that collectively form the second intake 710.

Likewise, the third intake 712 comprises a plurality circumferentially spaced, slot-shaped through-holes 713 disposed radially outwards from and preferably concentric with the second intake 710. Preferably, each of the slot-shaped through-holes 713 that together define the third intake 712 also is angled with respect to an imaginary line R extending radially from the central axis X of the first intake 708 to said through-hole 713.

As depicted, the first, second, and third intakes 708, 710, 712 are concentric about an imaginary axis X, preferably aligned with a center of the convection fan 500 that will be disposed behind the convection shroud 700, which extends along the influx air-flow path for air being drawn by the convection fan 500 through the convection shroud 700, in-use. While FIGS. 4A and 4B depict the convection shroud 700 including each of the first, second, and third intakes 708, 710, 712, it is contemplated that other embodiments can have any combination of the first, second, and/or third intakes 708, 710, 712 and possibly additional intakes. It is further contemplated that the second and third intakes 710, 712 need not comprise a plurality of respective slot-shaped through-holes 711, 713; rather, they can comprise any other geometrically-shaped aperture; for example circumferentially extending single slots, as opposed to pluralities of smaller slots that are arranged along a circumferential path.

Figure 5:
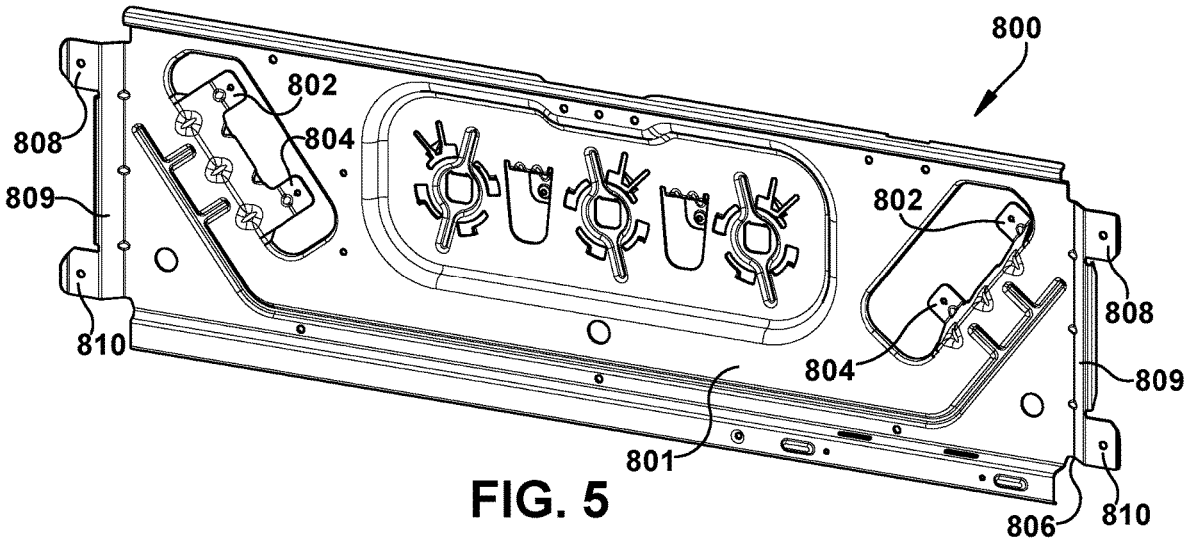
FIG. 5 is a rear, perspective view of the mounting bracket shown in FIG. 2.

Moving now to FIG. 5, a rear view of the mounting bracket 800 is shown. The mounting bracket 800 as shown has a plate-like body 801 (e.g., stamped) having a generally rectangular shape. However, it is contemplated that that the mounting bracket 800 may have any other geometric shape. The mounting bracket 800 includes a plurality of mounting tabs, all formed integral therewith (preferably during a common stamping process such that the tabs are formed as part of the bracket 800 from a common piece of sheet metal). Alternatively, the plurality of mounting tabs may be formed separate from the mounting bracket 800 and subsequently secured thereto. The below disclosure details various mounting tabs of the mounting bracket at only a single side thereof (e.g., a right side). It is to be understood that the other side (e.g., left side) of the bracket preferably has a similar, mirror-image structure in the disclosed embodiment.

First and second tabs 802, 804 are disposed internal to a lateral edge 806 of the body 801 and, as will be explained further below, are configured to secure the mounting bracket 800 to an external, rear surface of the rear wall 406 of the cavity wrapper 400. The first and second tabs 802, 804 at each side of the bracket 800 extend forward, away from the body 801 (i.e., in a direction towards the rear wall 406, when installed). Further, third and fourth tabs 808, 810 at the same side of the mounting bracket 800 are disposed at the lateral edge 806 of the body 801 extending laterally therefrom, and as will be discussed below, are configured to secure the mounting bracket 800 to structural elements of the appliance; e.g. to an inner surface of the outer body 102. The third and fourth tabs 808, 810 can be disposed at a peripheral edge of a lateral, rear-extending flange 809, for example if it is desired that the tabs 808, 810 be disposed rearward of (but substantially parallel to) the body 801 of the mounting bracket 800.

As shown, the first and second tabs 802, 804 are staggered with respect to one another such that the first and second tabs 802, 804 are neither vertically nor horizontally aligned. As will be further described, the spacing and staggering of the first and second tabs 802, 804 are selected to correspond and to be in-register with that of a counterpart pair of the apertures 420, 422 in the rear wall 406 of the cavity wrapper 400 thereof, in order to facilitate installation thereto. In contrast, the third and fourth tabs 808, 810 are vertically aligned along a respective side of the lateral edge 806 of the body 801. Moreover, it is to be understood that the mounting bracket 800 may include additional tabs (not shown) to further secure the mounting bracket 800 to the cavity wrapper 400 and/or structural elements of the cooking appliance 100.

Figure 6:
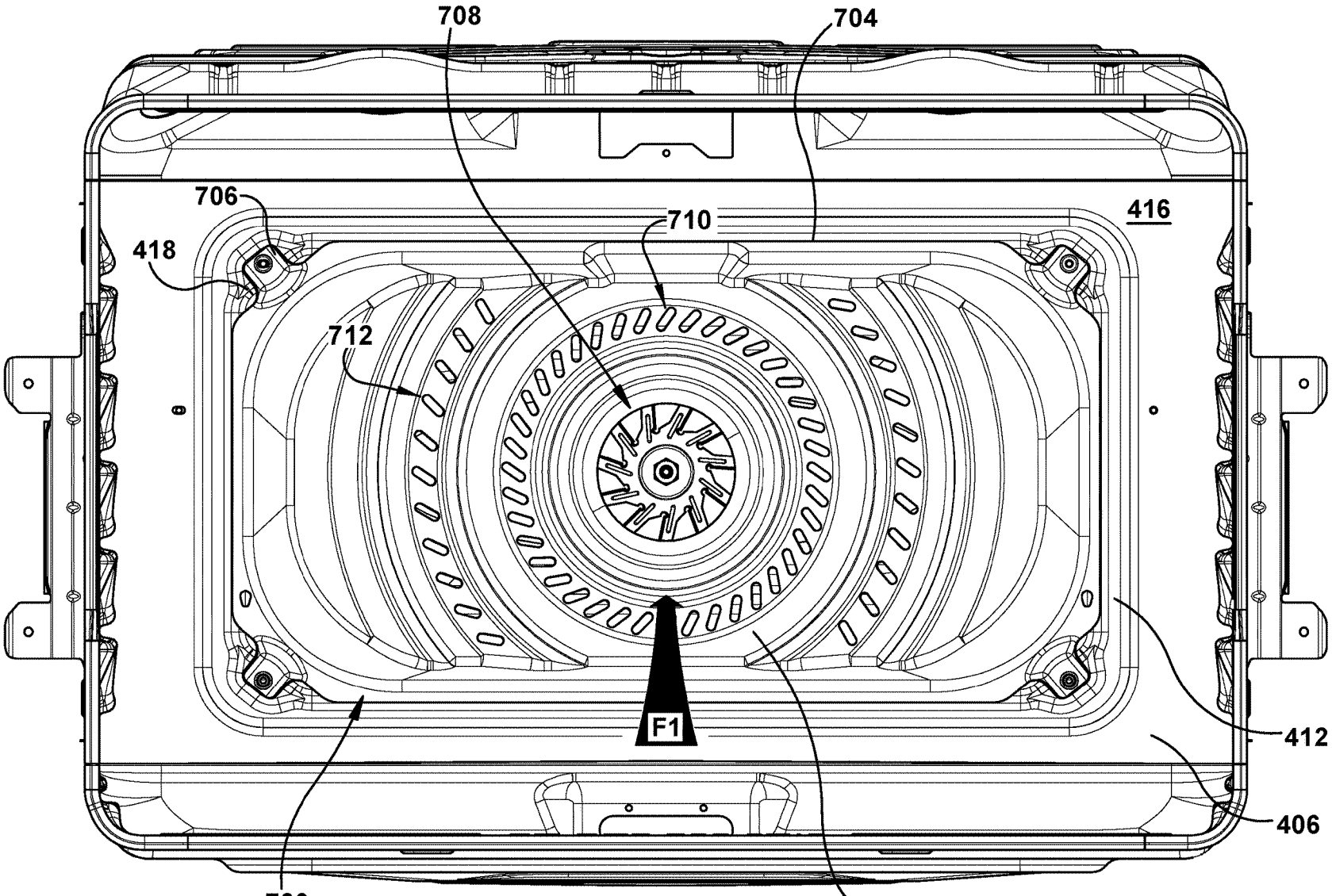
FIG. 6 is a front view of the cavity wrapper in FIG. 2, which has been installed to the mounting bracket at its rear and having the convection shroud installed therein.
Figure 7:
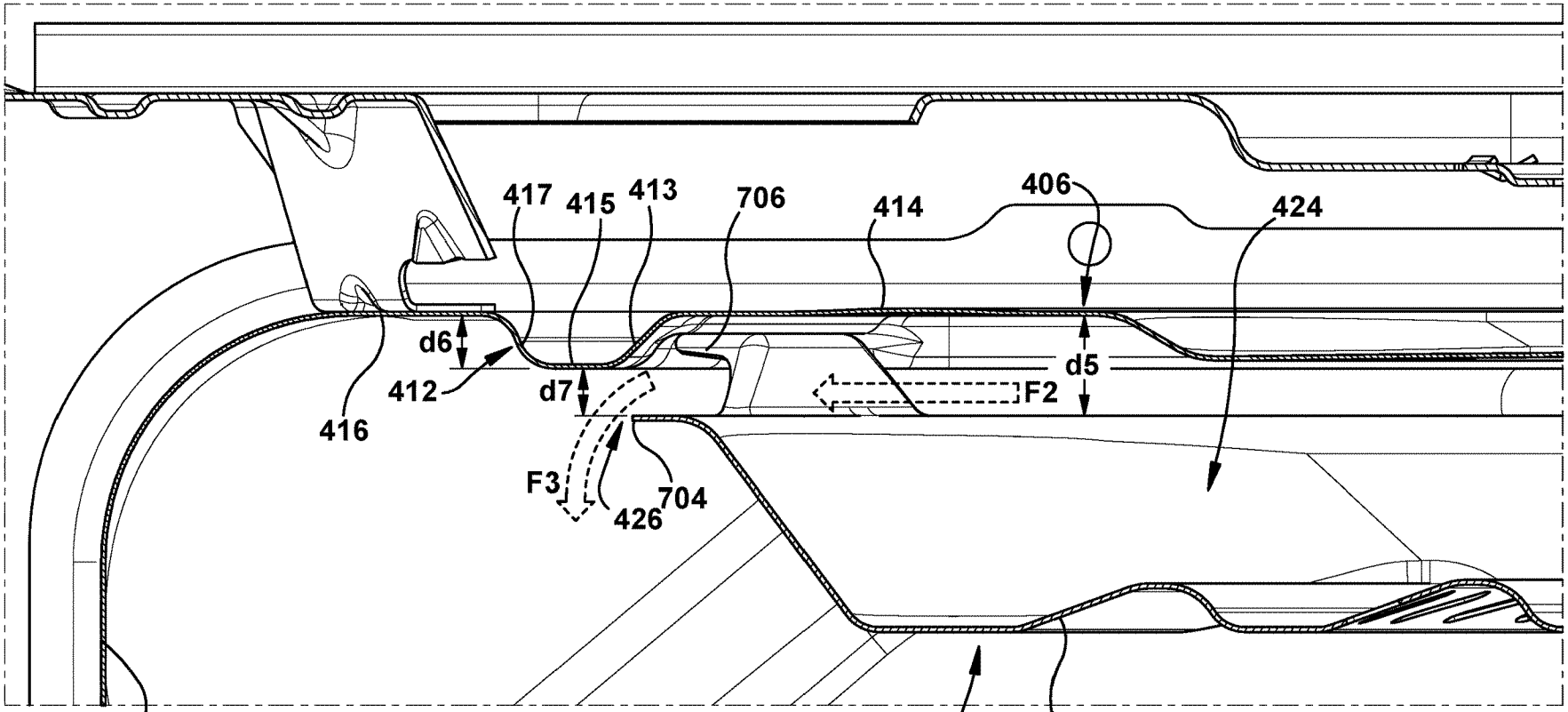
FIG. 7 is a partial cross-sectional view of the cavity wrapper installed together with the mounting bracket and the convection shroud as in FIG. 6, taken along the dashed line 7-7 in FIG. 6.

Moving now to FIG. 6, features of the oven 300 are shown in an assembled state removed from the outer body 102 of the cooking appliance 100. As depicted, the convection shroud 700 is installed adjacent and over the rear wall 406 of the cavity wrapper 400, within the cooking cavity 410 such that the embossment 412 circumscribes the perimeter edge 704 of the convection shroud 700 when viewed from the front, from within the cooking cavity 410. That is, the perimeter edge 704 of the convection shroud 700 follows in perimeter adjacency and defines a substantially fixed spacing with the closed shape of the embossment 412. Each of the mounting feet 706 of the convection shroud 700 is seated in a respective one of the receptacles 418 in the rear wall 406 and is secured thereto via appropriate fasteners (e.g., via screws, nuts/bolts, etc.). Accordingly, the convection shroud 700 is substantially in register with the inner portion 414 of the rear wall 406 (as best shown in FIG. 7). This configuration defines a heating chamber 424 between the rear wall 406 of the cavity wrapper 400 and the shroud 700 (as shown in FIG. 7), which houses the convection fan 500 and the convection heating element 600, as-assembled. The heating chamber 424 is separated from the main volume of the cooking chamber 410 via the convection shroud 700, but the main volume of that chamber remains in fluid communication with the heating chamber 424 via the first, second, and third intakes 708, 710 and 712, as well as an exhaust port 426 defined as the spacing between the perimeter edge 704 of the convection shroud 700 and the embossment 412.

As will be understood, the convection shroud 700 substantially covers the convection fan 500 and the convection heating element 600. The convection fan 500 is located so as to be coaxial with the first intake 708 formed in the body 702 of the convection shroud 700. Moreover, the convection heating element 600 at least partially surrounds the convection fan 500 behind the convection shroud 700 within the heating chamber 724, such that air expelled by the convection fan 500 will be heated by the heating element 600 before being exhausted back into the cooking chamber 410 via the exhaust port 426.

As best shown in FIG. 7, the exhaust port 426 is defined as a gap between the rear wall 406 of the cavity wrapper 400 and the convection shroud 700, and more particularly between the embossment 412 and the perimeter edge 704 of the convection shroud 700 as noted above. As also mentioned above, the mounting feet 706 of the convection shroud 700 include a stand-off portion 716 extending rearward away from the body 702 thereof, for example a distance d5. Moreover, the embossment 412 protrudes into the volume of the cooking chamber 410 (i.e., forward from the inner or outer portions 414, 416 of the rear wall 406) a distance d6. As shown, the distance d5 is greater than the distance d6; the difference between those distances yields a distance d7, which defines the height of the exhaust port 426 measured along an imaginary line perpendicular to the rear wall 406.

The exhaust port 426 can have the same height d7 around the entire periphery of the heating chamber 424. Alternatively, the exhaust port 426 can have a variable height d7 that varies at different locations about the periphery of the heating chamber 424. For example, the embossment 412 can extend forward into the volume of the cooking chamber 410 at varying distances d6 at different locations along its path. Thus, while the distance d5 (i.e., the distance the mounting feet 706 extend from the body 702 of the shroud 700) does not change (in an example embodiment), a variable distance d6 of the embossment 412 along its path can yield a variable height d7 of the exhaust port 426 at the corresponding locations. In this manner, the exhaust port 426 can be adjusted (i.e., tuned prior to or during manufacturing) to adjust the relative air flow through the exhaust port 426 at different locations about the convection shroud 700 in order to tune and optimize the convective air flow characteristics to optimize thermal- energy distribution and hence cooking within the particular cooking chamber 410 of a specific oven 300, including taking into consideration other extrinsic factors that can impact the uniformity of thermal-energy distribution and air-flow, such as, e.g., fan motor speed, fan blade design, heating element shape, heating element power setting, intake design, the shape and thermal characteristics of cavity-wrapper walls, other heat-sources and sinks in the appliance (within or adjacent to the cavity wrapper), oven-door characteristics and thermal losses, etc.

The desired variable-height configuration of the exhaust port 426 in a particular configuration need not be empirically calculated; though that can be done (e.g. via finite-element analysis if sufficient details about the thermal and operative characteristics of the appliance are known). Rather (or alternatively), the specific variable-height configuration to be used in a particular application can be determined empirically, through an iterative process with a prototype of the appliance, in order to tune the convective air-flow characteristics of the cooking chamber 410 during a convection-cooking operation. For example, if the left-hand side of the chamber 410 is not heated as efficiently as the right-hand side based on empirical data, the height of the exhaust port 426 can be increased along the left-hand side in order to reduce the construction of air flow in that region, and thus heat that side more efficiently. In a further alternative, it may be found in a specific appliance that air-flow velocity contributes more strongly to efficient heating in a particular region than volumetric flow, in which case it may be desired actually to constrain the exhaust port 426 height at that location, to yield a greater velocity of flow. As noted, the particular variable air flow characteristics in a given application can be determined via calculation or empirically, and then adjusted to conform to the desired variable air flow configuration by varying the height d7 of the exhaust port 426 along its path about the convection shroud 700.

As further shown in FIG. 7, the embossment 412 has a polyline cross-section comprising a first sloped (leading) portion 413, a second facing portion 415, and a third sloped (trailing) portion 417. Preferably, the second facing portion 415 lies on an imaginary plane substantially parallel with the planar expanse of the rear wall 406 (e.g. either the inner or outer portions 414, 416 thereof). Preferably, the first sloped (leading) portion 413 of the embossment 412 depends from the inner portion 414 of the rear wall 406, leading toward the second facing portion 415 of the embossment 412, whose spacing d7 from the perimeter edge 704 of the convection shroud 700 defines the exhaust port 426. Moreover, the first sloped (leading) portion 413 of the embossment 412 is angled or sloped at an obtuse angle with respect to the inner portion 414 of the rear wall 406, such that air flow directed radially from the convection fan 500 will impinge the first sloped (leading) portion 413 and be redirected substantially forward as it exits via the exhaust port 426 into the main volume of the cooking chamber 410. Moreover, the convection shroud 700 is disposed over the first sloped (leading) portion 413 of the embossment 412 such that the first sloped (leading) portion 413 is substantially covered by the convection shroud 700 in a front view of the cavity wrapper 400.

In operation, the convection fan 500 initially draws air from the main volume of the cooking chamber 410, through the convection shroud 700 and into the heating chamber 424, along a first flow path Fl, via at least the first intake 708; i.e. along the axis X of the convection fan 500 and the first intake 708 (see FIGS. 4A and 4B). The secondary intakes (i.e., the second and third intakes 710, 712) increase the total volume of air being drawn into the heating chamber 424. In particular, the second and third intakes 710, 712 preferably are arranged in respective circumferential arrays dimensioned to have respective diameters that are both greater than an outermost diameter of the convection fan 500.

Accordingly, the convection fan 500 preferably does not directly induce airflow through the secondary intakes. Rather, with respect to the airflow entering the heating chamber 424 (via the first intake 708) and flowing therethrough, the second and third intakes 710, 712 are positioned fluidly downstream from where the air enters the first intake 708 within the heating chamber 424, where a velocity of the airflow entering via the first intake 708 passes the second and third intakes 710 and 712 at relatively high velocity and relatively low pressure.

This low-pressure area draws in extra airflow through the respective plurality of slot- shaped through-holes 711, 713 of the second and third intakes 710, 712, thus yielding about a 30% increase in total airflow induction by the convection fan 500 compared to if only the first intake 708 were present. Additionally, the heated airflow exiting the heating chamber 424 (detailed further below) is more evenly distributed across a load (e.g., food, liquid, etc.) within the cooking chamber 410. Specifically, because the overall intake area of the heating chamber 424 is increased in comparison to a convection shroud 700 having only a single intake, the (heated) airflow being drawn from the cooking chamber 410 and into the heating chamber 424 is more evenly distributed across the load during convective heat transfer, resulting in more even cooking of the load.

As further shown in FIG. 7, after the air has entered the heating chamber 424 (via the first flow path Fl) the air is then directed radially outwards along a second flow path F2 toward the embossment 412. The convection heating element 600 heats the air flowing along the second flow path F2 as it flows within the heating chamber 424 toward the embossment 412 and toward the exhaust port 426, for downstream heat transfer with the load (e.g., food, liquid, etc.) within the cooking chamber 410.

As the air flowing along the second flow path F2 reaches the embossment 412, the air is redirected via the first sloped (leading) portion 413 of the embossment 412 along a third flow path F3, through the exhaust port 426 of the heating chamber 424 substantially forward and into the main volume of the cooking chamber 410 where food is being cooked. The air is redirected by the first sloped (leading) portion 413 of the embossment 412 such that the third flow path F3 circulates the heated, convective air flow toward the central area of the cooking chamber 410, and more particularly, over the load (food being cooked) therein. The angle of the first sloped (leading) portion 413 of the embossment 412 relative to the inner portion 414 of the rear wall 406, along with the height d7 of the exhaust port 426 at a particular location, together define the third flow path F3 that convective air flow exiting the heating chamber 424 will follow at a given location along its path. Both of these could be variable and iterated (or calculated) along the path of the exhaust port 426 if desired to tune the air flow within the cooking chamber 410 of a particular oven 300 as discussed above with respect to the height d7. Once the variable exhaust-port height and variable slope-angle for the first sloped (leading) portion 413 of the embossment 412 are known for a particular application, the conforming embossment 412 having those variable characteristics can be stamped from a single piece of sheet metal.

It may be necessary to fashion a dedicated die or other stamping tool to match the desired variable characteristics of the embossment 412; i.e. variable height d7 and/or slope angle of the first sloped (leading) portion 413 of the embossment. However, once those characteristics have been optimized for a particular appliance having known or predetermined features, only one such custom die/tool will be required per appliance model. That is, once the idealized convective air flow characteristics are known for a given appliance, they can be routinely reproduced for individual units of the otherwise identically configured appliance conforming to that model using a dedicated die/tool.

The embossment 412 provides a barrier such that the air directed along the second flow path F2 does not reach the perimeter walls of the cavity wrapper 400. That is, the expelled air from the heating chamber 424 does not directly impinge any one of the top wall 402, the bottom wall 404, and the opposing side walls 408. Accordingly, the heated air exhausted from the heating chamber 424 does not travel the entire span of the rear wall 406 to be redirected forward toward the main volume of the cooking chamber 410 via those perimeter walls, which therefore do not act as heat-sinks drawing energy therefrom. Rather, the heated air is redirected via the embossment 412 directly to the main volume of the cooking chamber 410, thus increasing cooking efficiency. In particular, by confining the heating chamber 424 to the area between the convection shroud 700 and the portion of the rear wall 406 bounded by the embossment 412, which encloses the convection heating element 600 and eliminates convective heat-transfer to the perimeter walls of the cavity wrapper 400, thermal energy in the heated (convected) air is not lost before reaching the cooking load, thereby resulting in more efficient use of energy for cooking. Moreover, because the embossment 412 is provided integral with the rear wall 406, additional elements (e.g., deflectors) are not required for redirecting the air, thus reducing cost and complexity of the oven 300.

Figure 8:
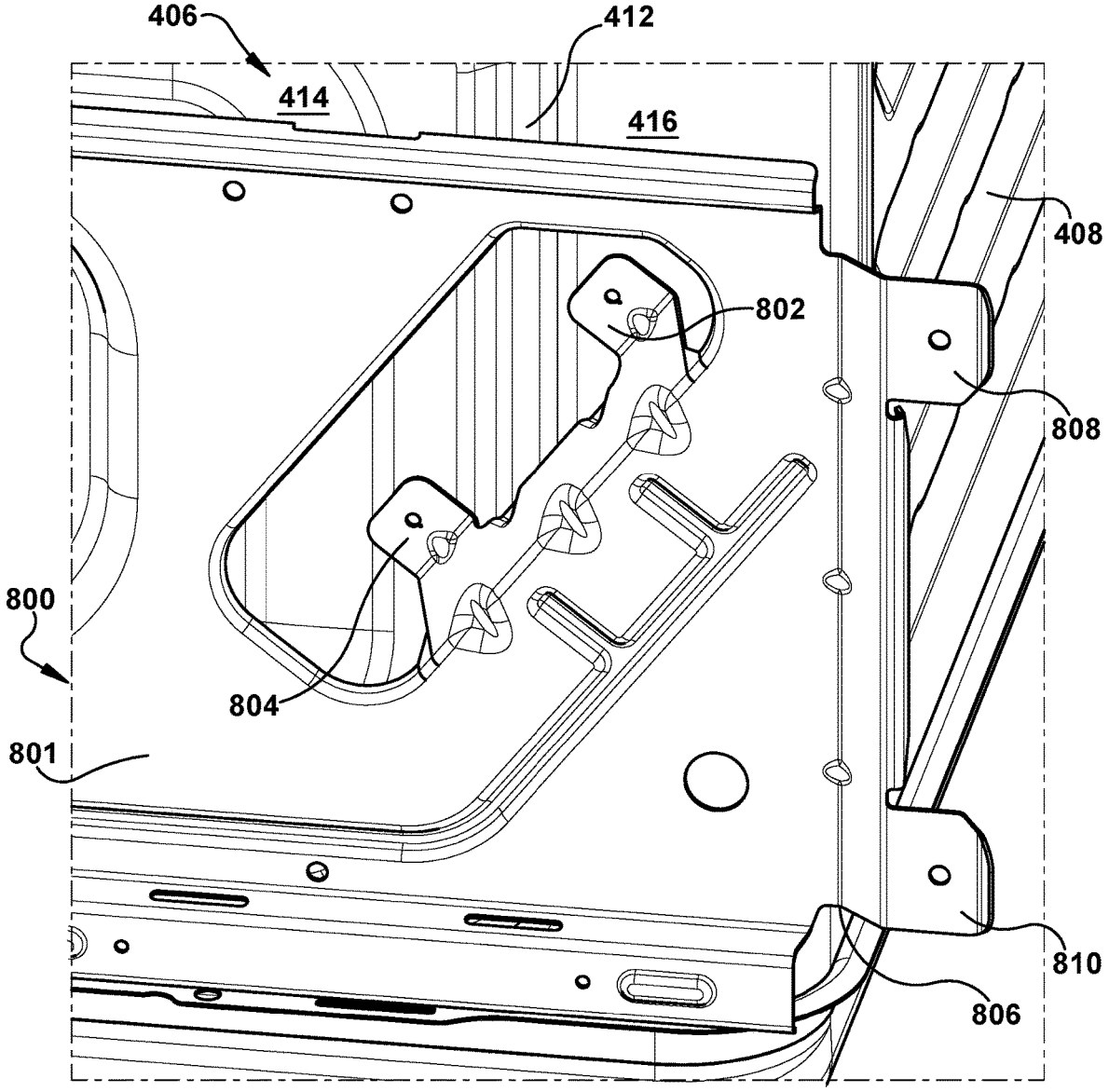
FIG. 8 is a partial, rear perspective view of the assembly in FIG. 6, showing the mounting bracket attached to the rear of the cavity wrapper.

Moving now to FIG. 8, the mounting bracket 800 is shown from the rear in an installed configuration relative to the rear wall 406 of the cavity wrapper 400. Specifically, the mounting bracket 800 is disposed adjacent an external, rear surface of the rear wall 406 of the cavity wrapper 400. Moreover, the mounting bracket 800 is arranged such that the first and second tabs 802, 804 are disposed in register with and adjacent the first and second apertures 420, 422 respectively, formed at the same (lateral) side in the rear wall 406. In the depicted embodiment, each of the first and second tabs 802, 804 includes an aperture that is configured to be coaxial and aligned in register with a respective one of the first and second apertures 420, 422 in order to properly align and secure the mounting bracket 800 to the cavity wrapper 400 at the correct position. Thus, in the installed position, the first and second tabs 802, 804 are in a staggered formation and straddle the embossment 412 where they attach to the rear wall 406 of the cavity wrapper 400, such that the first tab 802 is affixed to the outer portion 416 of the rear wall 406 and the second tab 804 is affixed to the inner portion 414 of the rear wall 406.

In this manner, the embossment 412 strengthens the cavity wrapper 400 in the vicinity of its points of attachment to the mounting bracket 800 used to affix it within the appliance. That is, the embossment 412 provides robust attachment points for affixing the cavity wrapper 400 to the bracket 800, and thus to the appliance. In this manner, support loads of the cavity wrapper 400 are efficiently transmitted (via the mounting bracket 800) to the structural elements of the appliance (e.g. outer body 102), to which it is mounted via lateral tabs 808, 810. More particularly, by fastening the mounting bracket 800 (via the first and second tabs 802, 804) to the cavity wrapper 400 at locations adjacent to and straddling the embossment 412, the support loads are carried at locations where the wrapper is strengthened as a result of the embossment 412.

Furthermore, the above-noted configuration provides multiple attachment points to distribute the support loads over different strengthened locations, as opposed to concentrating the support loads at a single location. This enhances structural stability of the cavity wrapper 400 during production, transportation, and normal use. Moreover, positioning the first and second tabs 802, 804 such that they are at different elevations provides additional orientation support to the cavity wrapper 400, so that the cavity wrapper 400 is better reinforced to resist twisting from torsional loads as may be experienced by the appliance; e.g. while in transit. Such vertical spacing between the first and second tabs 802, 804 further separates the affixation points, thus further distributing the support loads and avoiding concentration thereof.

Another benefit resulting from the aforementioned configuration is that thermal expansion of the (relatively large) rear wall 406 of the cavity wrapper 400 is effectively reduced, by discretizing the rear wall 406 into two smaller areas—the inner portion 414 and the outer portion 416. In this manner, the inner and outer portions 414, 416 can expand and contract independently, wherein the embossment 412 effectively acts as a spring or accumulator between them. Moreover, because these two discretized areas are secured to structural features of the appliance (e.g. the outer body 102) separately (i.e., the inner and outer portions 414, 416 being affixed to the first and second tabs 802, 804, respectively), any resulting flexure can be reduced into smaller incremental deflections characteristic of the individual, smaller, inner and outer portions 414, 416, compared to flexure that would occur for the entire rear wall 406 without the above-discussed embossment 412.

In sum, the first and second tabs 802, 804 of the mounting bracket 800 straddle the embossment 412 formed in the cavity wrapper 400 to facilitate affixation thereto at points located on either side of the embossment 412, and at different elevations, to the respective inner and outer portions 414, 416 of the rear wall 406. This provides robust, strengthened affixation and attachment points that are relatively close together (yet which distribute support loads across the embossment 412 at different elevations), which aids rapid and automated assembly, as well as improved orientation/structural stability. This configuration also reduces thermal stresses by reducing the magnitude of thermal-expansive flexure by discretizing the rear wall 406 into the inner and outer portions 414, 416, each of which is capable of flexing independently of the other at a smaller magnitude than their sum. Accordingly, in addition to acting as a landmark that facilitates rapid placement and orientation of the first and second tabs 802, 804 (one on either side of the embossment 412) of the cavity wrapper 400, whether via manual or automated assembly, the embossment 412 also provides additional strength and reduces flexure stresses.

While the above disclosure details the first and second tabs 802, 804 being fixed to the rear wall 406 of the cavity wrapper 400 via fasteners (e.g., screws, bolts, rivets, etc.), it is to be understood that other methods of fixation are contemplated. For example, the first and second tabs 802, 804 can be secured to the cavity wrapper 400 via soldering, welding, or other known methods.

Although not shown, the third and fourth tabs 808, 810 can be configured to secure the mounting bracket 800 to a rear wall of the outer body 102 of the appliance 100. Alternatively, the mounting bracket 800 can be configured such that each pair of the third and fourth tabs 808, 810 secures the mounting bracket 800 to respective opposing side walls of the outer body 102, or to other structural elements of the appliance to which the outer body 102 (or decorative outer panels) is (are) affixed. In this manner, the mounting bracket 800 interconnects the outer body 102 and the cavity wrapper 400.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An appliance comprising:

a cavity wrapper having a rear wall and defining a cooking chamber therein;

an embossment formed in the rear wall following an enclosed shape and protruding within the cooking chamber, said embossment having a leading sloped portion that protrudes into the cooking chamber;

a shroud located adjacent the rear wall and defining therewith a heating chamber that is partially isolated from a main volume of said cooking chamber, the shroud having a primary intake therein, an outer perimeter edge of said shroud being spaced from and adjacent to the embossment thereby defining an exhaust port therebetween; and a fan disposed within the heating chamber and configured to draw air from said main volume into the heating chamber via the primary intake, and to expel said air from the heating chamber back into said main volume via the exhaust port such that expelled air is redirected substantially forward into said main volume based on an angle of said leading sloped portion of said embossment.

2. The appliance of claim 1, said outer perimeter edge of said shroud substantially following said embossment in perimeter adjacency therewith about said enclosed shape, such that said exhaust port extends about substantially the entire enclosed shape.

3. The appliance of claim 1, the cavity wrapper further comprising a top wall, a bottom wall, and a pair of opposing side walls, said leading sloped portion of said embossment being effective to redirect expelled air from the heating chamber such that the expelled air does not directly impinge any one of the top wall, the bottom wall, and the opposing side walls.

4. The appliance of claim 1, the rear wall of said cavity wrapper having an inner portion defined within the enclosed shape of said embossment, and an outer portion surrounding the embossment, said leading portion thereof depending from said inner portion, said shroud being disposed over said inner portion.

5. The appliance of claim 4, said shroud being aligned with said inner portion.

6. The appliance of claim 4, the rear wall of said cavity wrapper having a receptacle formed in said embossment, said shroud having a mounting foot depending from a body thereof, said mounting foot being complementarily received within said receptacle to secure the shroud to the rear wall of the cavity wrapper.

7. The appliance of claim 1, the embossment further comprising a trailing sloped portion, the leading and trailing sloped portions being sloped with respect to a planar expanse of the rear wall, the leading sloped portion depending from an inner portion of said rear wall defined within said enclosed shape, the trailing sloped portion depending from an outer portion of said rear wall surrounding said embossment.

8. The appliance of claim 1, the outer perimeter edge of the shroud being uniformly spaced from the embossment about the enclosed shape thereof.

9. The appliance of claim 1, said angle of said leading sloped portion being variable at different respective locations along said enclosed shape, adapted to locally adjust a precise direction of air expelled at the respective locations to account for unique thermal properties of the specific appliance.

10. The appliance of claim 1, further comprising:

an outer cabinet having a front opening;

a cooktop located at a top side of the outer cabinet and having at least one cooktop heating element; and a door pivotably attached to the outer cabinet and selectively covering the front opening, said cavity wrapper being disposed within said outer cabinet and accessible through the front opening.

11. The appliance of claim 10, further comprising a bracket that secures the cavity wrapper within the appliance, the bracket comprising a first pair of mounting tabs affixed to an external surface of said rear wall from behind the cavity wrapper, wherein the first pair of mounting tabs have a staggered formation and straddle the embossment.

12. The appliance of claim 11, said bracket further comprising a second pair of mounting tabs affixed to said external surface from behind the cavity wrapper and also having a staggered formation straddling the embossment, wherein the first pair of mounting tabs are disposed adjacent a first lateral side of the rear wall and the second pair of mounting tabs are disposed adjacent a second, opposing lateral side of the rear wall.

13. The appliance of claim 1.

said embossment being continuous along an uninterrupted closed path such that the embossment defines an inner portion and an outer portion of the rear wall, the inner portion being surrounded by the embossment, and the outer portion surrounding the embossment, said leading sloped portion depending from said inner portion of the rear wall and being sloped with respect to a planar expanse of the rear wall.

14. The appliance of claim 13, the shroud further comprising a secondary intake concentric with the primary intake, wherein the primary intake is an aperture located at a central portion of the shroud, the secondary intake comprising a plurality of circumferentially spaced through-holes disposed radially outwards from the primary intake, such that the plurality of through-holes circumscribe the primary intake.

15. The appliance of claim 13, said shroud covering the leading sloped portion of the embossment.

16. An appliance comprising:

a cavity wrapper defining a cooking chamber therein;

an embossment formed in a rear wall of the cavity wrapper and protruding within the cooking chamber; and a bracket disposed outside the cavity wrapper and adapted to provide support thereto, the bracket comprising a first pair of mounting tabs affixed to an external surface of the rear wall of the cavity wrapper straddling the embossment in a staggered formation, the embossment defining an inner portion of the rear wall surrounded by the embossment and an outer portion of the rear wall surrounding the embossment, wherein a first one of said first pair of mounting tabs is attached to the inner portion of the rear wall and a second one of said first pair of mounting tabs is attached to the outer portion of the rear wall.

17. The appliance of claim 16, said bracket further comprising a second pair of mounting tabs affixed to said external surface and also straddling the embossment in a staggered formation, wherein the first pair of tabs are disposed adjacent a first edge of the rear wall and the second pair of tabs are disposed adjacent a second, opposing edge of the rear wall.

18. The appliance of claim 16, the bracket further comprising a plate-shaped body having a lateral edge, wherein the first pair of mounting tabs extend away from the plate-shaped body towards the rear wall of the cavity wrapper, such that the plate-shaped body is spaced from said rear wall by said mounting tabs.

19. The appliance of claim 16, the embossment being adapted such that the inner and outer portions of the rear wall are permitted to flex independently of one another such that a sum of their respective deflections in response to an external point load will be less than that of the rear wall in response to said external point load absent said embossment.

* * * * *